US005356050A

United States Patent [19]

Hahn et al.

[11] Patent Number: 5,356,050

[45] Date of Patent: Oct. 18, 1994

[54] AIR PRESSURE GLUE APPLICATION HEAD

[76] Inventors: Daniel A. Hahn; Donald H. Stover, both of 515 W. Main St., Greenville, Ill. 62246

[21] Appl. No.: 112,975

[22] Filed: Aug. 30, 1993

[51] Int. Cl.[5] ..... B65D 83/00

[52] U.S. Cl. ..... 222/394; 239/416.5; 239/DIG. 19

[58] Field of Search ..... 239/416.5, 416.4, 423, 239/424, 424.5, DIG. 19; 222/394

[56] References Cited

U.S. PATENT DOCUMENTS

| | | | |
|---|---|---|---|
| 3,348,520 | 10/1967 | Lockwood | 118/2 |
| 3,394,888 | 7/1968 | Dasse et al. | 239/424 |
| 3,481,308 | 12/1969 | Barton et al. | 239/416.5 X |
| 3,515,354 | 6/1970 | Presson | 239/416.5 |
| 4,494,698 | 1/1985 | Brown et al. | 239/DIG. 19 X |
| 4,785,996 | 11/1988 | Ziecker et al. | 239/298 |
| 4,844,003 | 7/1989 | Slaughterback et al. | 118/323 |
| 4,869,429 | 9/1989 | Brooks et al. | 239/DIG. 19 X |
| 4,957,783 | 9/1990 | Gabryszewski | 239/296 X |
| 4,969,602 | 11/1990 | Scholl | 239/298 |
| 4,970,985 | 11/1990 | Slautterback | 239/296 X |
| 5,065,943 | 11/1991 | Boger et al. | 239/298 |
| 5,169,071 | 12/1992 | Boger et al. | 239/296 |

FOREIGN PATENT DOCUMENTS 3162271 7/1991 Japan .

*Primary Examiner*—Andres Kashnikow
*Assistant Examiner*—Anthoula Pomrening
*Attorney, Agent, or Firm*—Don W. Weber

[57] ABSTRACT

A new apparatus for supplying discreet amounts of glue to sheets of paper positioned beneath glue heads is presented. The new glue nozzle consists of an essentially vertical chamber into which air pressure is introduced perpendicularly to the vertical alignment of the chamber. A glue needle is inserted down the center of the vertical chamber. Glue is supplied through the glue needle in droplets by applying pressure to the glue bottle. As a glue droplet accumulates at the bottom of the glue supply needle, a pulse of air is sent into the glue chamber and pushes the droplet off of the glue needle and onto the target. As the next sheet is moved into place underneath the glue needle, another droplet accumulates. When the droplet and sheet are aligned, a pulse of air blasts the droplet off the end of the needle onto the next sheet. Coordination of the accumulation of droplets, the pulse of the air, and the speed of the positioning of the target sheets allows an efficient method of depositing glue continually onto a large number of sheets.

12 Claims, 3 Drawing Sheets

AIR PRESSURE GLUE APPLICATION HEAD

BACKGROUND OF THE INVENTION

This invention relates to the field of nozzles for the application of glue. More particularly, it relates to a unique air pressure nozzle used to apply a discreet amount of glue to papers, envelopes, or similar articles.

The application of glue to surfaces has long been the subject in the particular field of sealing envelopes, cartons, and other types of products. Different types of glue heads and nozzles have been devised in order to make the application of glue to a surface efficient.

In the field which particularly relates to the application of small discreet quantities of glue to a continual supply of envelopes or the like, a problem has been encountered due to the nature of glue itself. The glue tends to coagulate at the nozzle end, clogging the delivery system.

Most of the nozzles or other applicators for applying a discreet amount of glue to a continual stream of paper articles involve either a pumping action by a piston or the continual application of air pressure in order to elongate the stream of glue.

In the first type of application, a contact head containing a ball bearing is used to apply the glue in a start-and-stop fashion. A "poppet head" glue nozzle applies glue under pressure by opening and closing a hole at the end of the nozzle. As the valve lifts, the glue comes out. As the valve is closed, glue stops. The pumping action of a piston often causes the glue to periodically clog the nozzle. This clogging occurs because glue itself is likely to coagulate and stick to a surface due to its nature.

A contact head application can operate efficiently at 8,000 to 8,500 sheets per hour to be glued. In this contact head application, downtime as well as delivery rate are factors which slow down the efficiency of the operation. In the instant device, the glue head is capable of applying glue to 17,000 sheets per hour over an eight hour day. (While the average is 13,000 sheets per hour, the instant application can reach even higher sheets per hour results given the correct conditions.) In an eight hour day, the instant invention can thus apply glue to 104,000 sheets of paper or other articles per day as opposed to 84,000 sheets per day utilizing the contact head system. It an object of this invention to provide a unique air pressure glue nozzle capable of achieving a high number of applications of glue to a continual stream of paper while being virtually trouble-free.

Applying the glue in a continuous fashion, using oblique air pressure jets to arrange the glue in a particular geometric pattern, has proven to be successful but the clogging of the nozzle still occurs.

The clogging of the glue nozzle creates a long downtime problem since the nozzles have to be unclogged or changed. It is another object of this invention to provide an air pressure nozzle which eliminates clogging at the nozzle tip. It is a further object of this invention to provide a unique method for replacing the glue nozzle in a simple and economical fashion.

The instant air pressure glue nozzle will accommodate all types of liquid resin glues, "pressure break" adhesives or "fugitive" glues of latex and its derivatives. These glues, while having distinctive names, all share the trait of forming an adhesive bond with the application of a pressure change. These adhesives also release with pressure, to allow the bond to be broken without harming the surfaces at the point of attachment, dependent upon the substrate to be glued.

Many delivery systems, as noted above, require mechanical means to start and stop glue flow and for timing the rate of glue application. This starting and stopping of the glue flow causes certain glues to set into their latex state, in one case clogging the applicator by its own mechanical design. The introduction of the instant system for applying glue deals with the necessary periodic nature of applying the adhesive to a continual stream of articles to be glued while still allowing a discreet amount of glue to be applied to the article.

Another problem encountered in the field deals with the wide variety of glues available. Different glues have different viscosities. (Viscosity is the measure of the thickness of the glue or other liquid measured in centerpoise (cp).) Water has a viscosity of approximately 24 at 72 degrees Fahrenheit. Whole milk has a viscosity of 250–300. The typical type of glue used in applying glue to a continual number of sheets on a paper folder has an average viscosity of approximately 150. The instant device is capable of applying glue in the manner below specified regardless of the viscosity of the particular glue used. It is a still further object of this invention to provide an air pressure glue nozzle capable of dispensing discreet amounts of glue regardless of the glue's viscosity. Other and further objects of this invention will become apparent upon reading the following Specification.

BRIEF DESCRIPTION OF THE DEVICE

An air pressure glue application head is disclosed comprising essentially a vertical cylindrical chamber which has a thin, needle-like glue dispensing component inserted into the center of the cylindrical chamber. At one side of the vertical chamber is a perpendicular inlet tube which supplies air at a certain pressure to the chamber itself. The lower end of the chamber tapers to a cylindrical but smaller end which has a cylindrical sleeve extending beneath the lower cylinder of the chamber. The tip of the glue needle is slightly above the lower end of the sleeve. The sleeve should be made of a slick non-porous material to avoid adhesion of the glue to the sleeve.

Glue is supplied under pressure to the glue needle at a specified rate. This specified rate allows a small droplet of glue to accumulate at the lower end of the glue needle within the teflon chamber. An air pressure solenoid is coordinated with the rate of deposit of the droplet at the end of the needle. At specified short intervals a blast of air pressure from the perpendicular air pressure inlet tube is pulsed through the chamber and down the teflon sleeve thus blowing off the droplet accumulated, depositing the droplet onto the paper to which the discreet droplet is to be applied. As another droplet accumulates another burst of air pressure deposits the discreet amount of glue accumulated at the bottom tip of the glue needle onto the next paper or article to which glue is to be applied.

Changing the gauge of the glue needle allows for different viscosities of glue to be deposited at a different rate.

The amount of pressure applied to the bottle of glue determines the rate of deposit of the droplets of glue at the end of the needle. Coordinating the air pressure solenoid with the accumulation of droplets allows the deposition of discreet amounts of glue to a large number of sheets of paper or other articles in an efficient manner. Coordinating the gauge needle, the rate of droplets at the glue needle tip, and the rate of pulse of the air pressure allows for the efficient use of this device.

DETAILED DESCRIPTION OF THE PREFERRED EMBODIMENT

Figure 1:
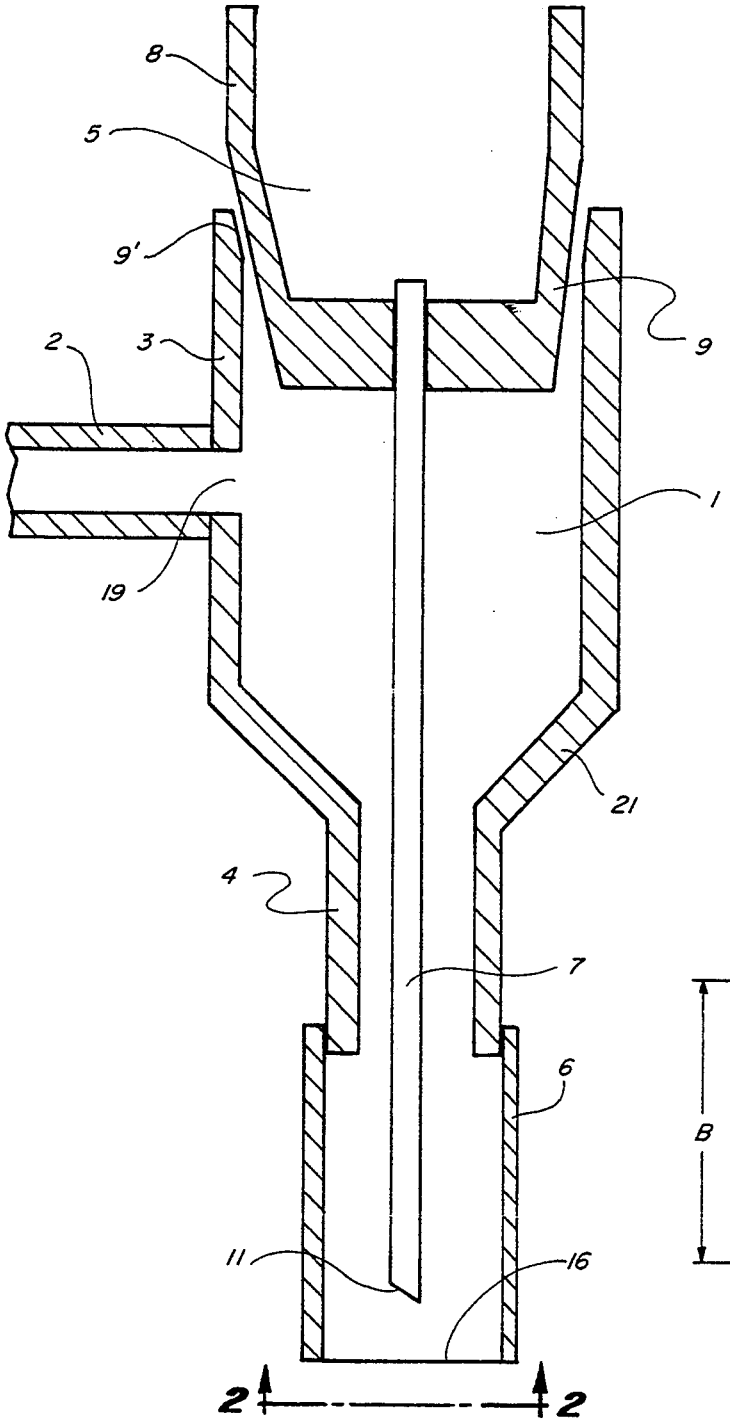
FIG. 1 is a side cutaway view of the main junction chamber, the glue supply assembly, and the air inlet tube.

This invention comprises three basic parts, including a main junction chamber 1 which is normally aligned in a vertical position. This outer vertical junction chamber 1 is in fluid connection with an essentially horizontal air pressure inlet tube 2. The junction chamber 1 is made up of a generally stainless steel body and is manufactured under the standard brand name of "Husky Hub". The junction chamber 1 has a generally expanded cylindrical upper portion 3 and a lower smaller cylindrical portion 4. The upper and lower portions are connected by a tapered portion 21.

At one side of the upper cylindrical portion 3 of the junction chamber 1 is an air pressure inlet tube 2. This air pressure inlet tube 2 is attached to the upper cylindrical portion 3 of the junction chamber 1 by standard threading. In the preferred embodiment a 10-32 male thread on the tube 2 attaches a 10-32 threaded female hole in the upper cylindrical portion of the chamber as shown on FIG. 1.

The tubing for the air inlet is, in the preferred embodiment, flexible tubing having a 7/32 inch outside diameter connected to a coordinating solenoid air valve. This solenoid air valve is shown schematically on FIG. 4.

Attached to the lower tapered portion 4 of the junction chamber 1 is a sleeve 6. This sleeve is made of a slick, non-porous material such as teflon. This teflon sleeve 6 surrounds the glue supply needle 7, as best shown on FIG. 1. The sleeve is removable for easy cleaning. The glue input supply assembly 5 comprises an upper cylindrical section 8 which is tapered at its lower end 9. The lower taper 9 of the glue supply assembly coincides with a slightly inward taper 9' of the upper portion of the main junction chamber 1 so that a snug, airtight fit is achieved when the glue supply assembly 5 is inserted into the main junction chamber 1 as shown on FIG. 1. This tapered configuration is generally known throughout the industry as a "Luer Lock" assembly.

Figure 2:
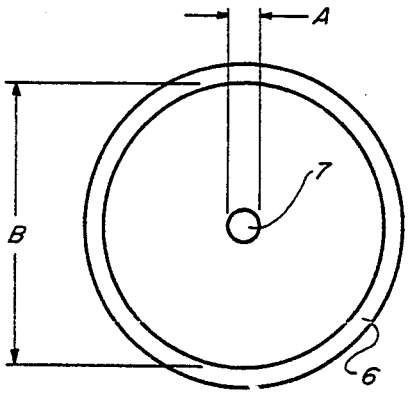
FIG. 2 is a bottom view, taken along line 2—2 of FIG. 1, showing the relationship of the glue needle to the diameter of the sleeve.

Protruding through the upper portion of the glue supply assembly 5 is a stainless steel glue needle 7. This glue needle 7 extends down the center of the main junction chamber 1 and the lower teflon sleeve 6 as shown in FIGS. 1 and 2. The diameter A of the opening of the needle may vary according to the specifications of the glue timing of the articles, and other variables. However, it has been found that a stainless steel glue needle ranging between 18 and 24 gauge is the preferred gauge for most applications of glue.

The lower portion 4 of the junction chamber cylinder is approximately 7 millimeters in length while the teflon sleeve 6 is approximately 18 millimeters in length as best shown on FIG. 1. The lower end 16 of the teflon tube is positioned approximately $\frac{1}{8}''$ above the paper to be glued.

Figure 3:
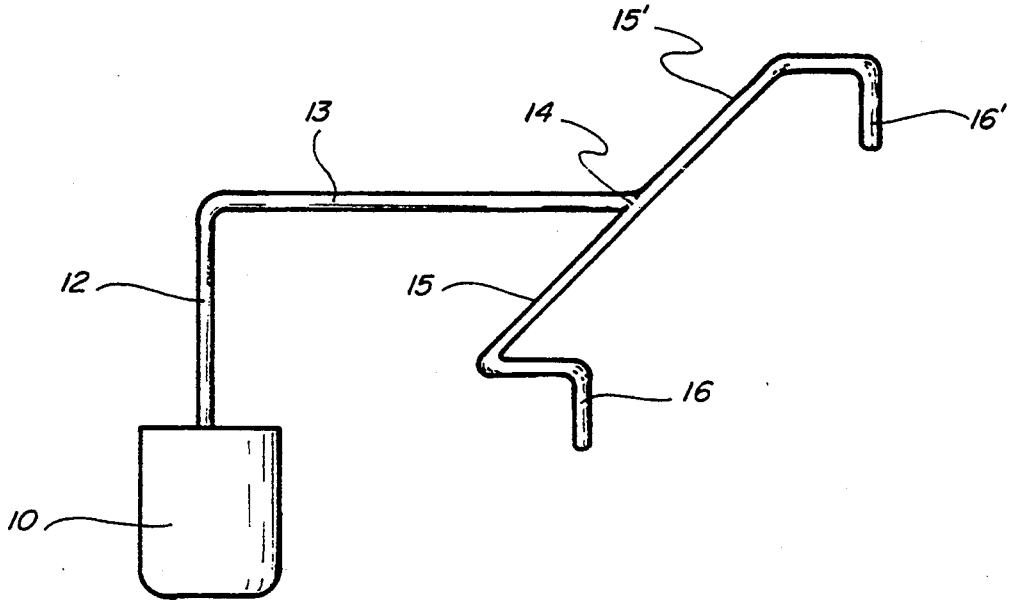
FIG. 3 is a schematic view of the glue bottle, glue delivery system and glue head.

Turning now to FIG. 3, a schematic layout of the gluing operation is shown. A glue bottle 10 is positioned on the floor near the glue supply assembly and the conveyor or other means for positioning papers beneath the glue nozzles. The glue bottle supplies glue to the glue supply assembly 5 by means of the pressurization of the bottle. (The amount of pressure applied to the glue bottle 10 will determine the rate of droplets eventually deposited at the end 11 of the glue needle 7. ) The normal pressure applied to the glue bottle is $\frac{1}{4}$ to $\frac{7}{8}$ pounds per square inch (psi). The greater the pressure supplied to the glue bottle, the more rapidly will the droplets of glue will be applied to the end 11 of the glue needle 7.

Glue is forced from the glue bottle 10, by means of the pressurization system, out a vertical glue feeder tube 12. This vertical glue feeder tube 12 may normally extend a vertical length of approximately three feet two inches from the top of the glue bottle to the horizontal glue feeder tube 13 and may be as long as six feet. The vertical glue feeder tube 12, in the preferred embodiment, has a 3/16" inside diameter and feeds glue to a one-eighth inch T 14 shown on FIG. 3. The glue is then split in half by the T along twin feeder tubes 15 and 15' thus supplying glue at the glue heads 16 and 16' respectively. (The glue heads 16 and 16' are comprised of the assembly shown on FIG. 1.) These twin feeder tubes 15 and 15' are approximately $3\frac{1}{2}$ inches long. These smaller feeder tubes 15 and 15' have a preferred inside diameter of $\frac{1}{8}''$.

Figure 4:
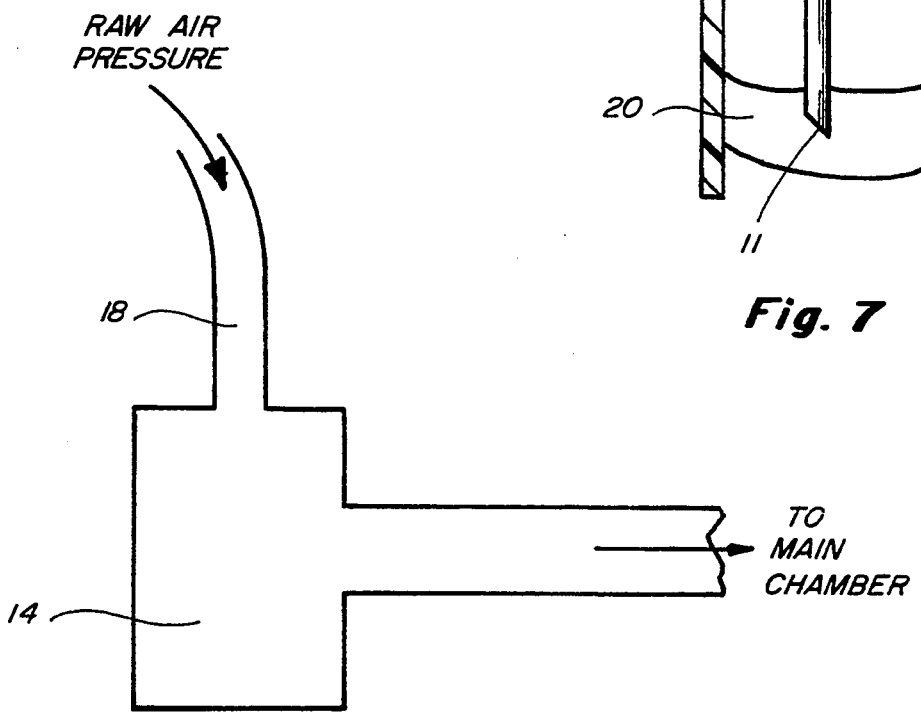
FIG. 4 is a side detailed schematic view of the raw air supply system, coordinating solenoid, and air pressure delivery inlet tube.

Pulsed air is supplied to the air pressure inlet tube 2 by means of an air pressure solenoid valve 17 (FIG. 4). Raw, presolenoid air pressure 18 is supplied to the solenoid at an air pressure between 5–30 psi and equal to or greater than three cubic feet per minute (cfm). The solenoid valve is electrically coordinated with the rate of deposition of the droplets at the end 11 of the glue needle 7 by means well-known in the art. The solenoid delivers air pressure at the air pressure inlet tube opening 19 at approximately 10 to 12 psi. This air pressure is introduced into the main junction chamber 1 at opening 19 and is then forced downwardly in a vertical path as best shown by the arrows on FIG. 7.

As the glue bottle 10 deposits droplets of glue 20 at the end 11 of the glue needle, a pulse of air is delivered to the droplet which forces the glue droplet 20 out the end of the teflon sleeve 6 and onto the paper or other material to which the droplet 20 is to be supplied.

The pulsed air supply delivers the glue droplet 20 to the target (paper, envelope or other target) by way of the second of the concentric nozzles 4 at the appropriate time. Deposition of the droplet in the proper location on the work is thus accomplished and the paper is moved along the conveyor line or other system while another droplet forms and another piece of paper or other target is positioned underneath the glue nozzle needle 7. The volume, pressure and timing of the laminar air pulse is dependent upon the viscosity of the glue, pressure of the glue bottle, speed of positioning of the article to which glue is supplied, and other factors.

Figure 5:
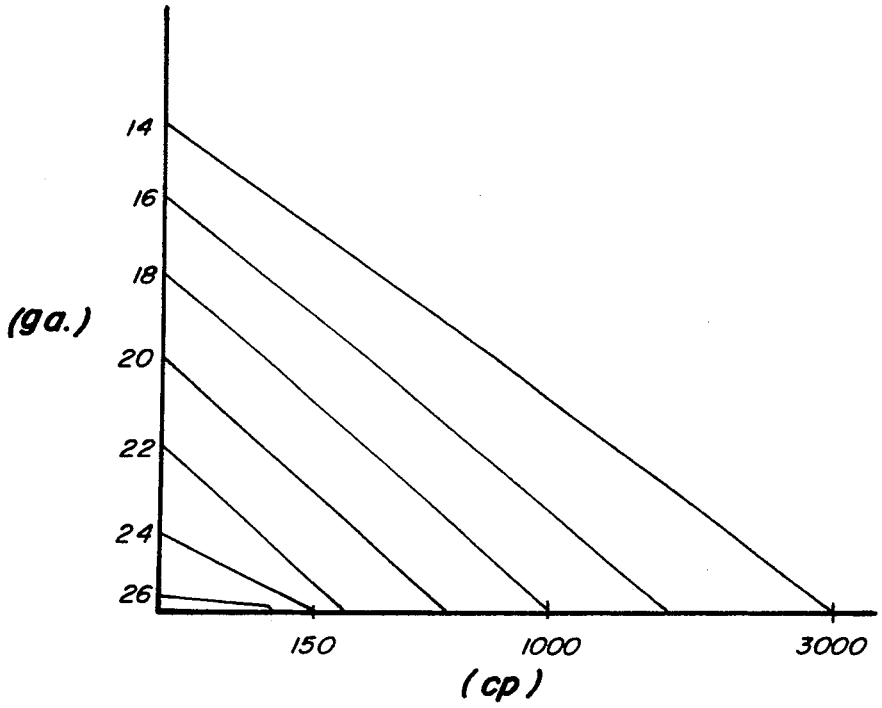
FIG. 5 is a graph showing the relationship between the viscosity of the glue to be applied and the gauge needle necessary for use with the described viscosities.

Different gauges of needles 7 are required for different viscosities of glue. The thicker the glue, the smaller the gauge needle (smaller gauged needles have larger inner diameters). Turning to FIG. 5, it can be seen that glues having a low viscosity (approximately 150 centerpoise) would require a small 24 gauge needle. As the viscosity increases to 1,000 centerpoise (cp), a larger 18 gauge needle would be required. A still thicker glue (3,000 cp) would require an even larger 14 gauge needle as shown on FIG. 5. The gauge of needle/glue viscosity ratios are as approximately shown on FIG. 5.

An "optimum running guide" can be achieved provided that the gauge needle, rate of depositions of glue droplets (determined by psi pressure on the glue bottle 10) and number of targets to which glue is to be applied is determined.

Figure 6:
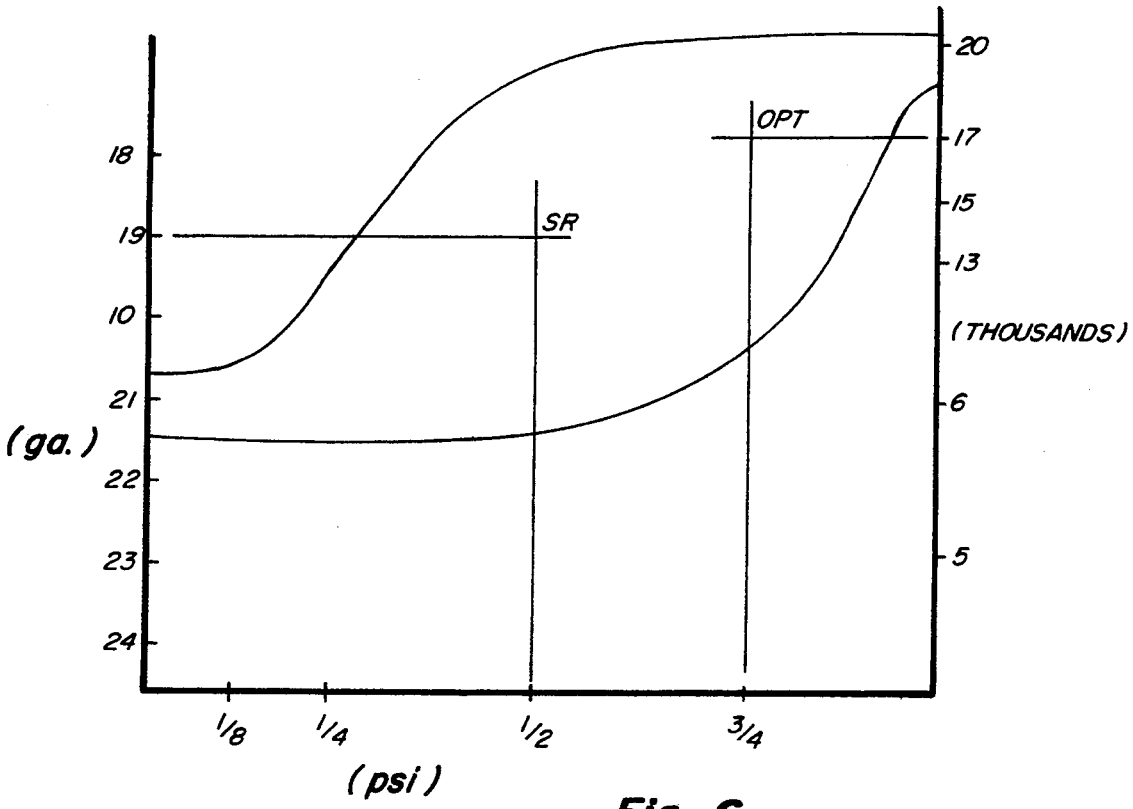
FIG. 6 is a graph showing the optimum relationship between the rate of pressure applied to the glue bottle, the gauge of needle required and the number of papers or other articles which may receive droplets in an hour of work.

FIG. 6 shows diagrammatically the recommended area of operation for this particular device. The recommended area of operation appears in the bulging shape shown in the graph. As the pressure on the glue bottle 10 is increased along the horizontal X-axis of the graph, the gauge of the needle required to successfully accomplish the work desired decreases (meaning that the gauge of the needle needs to be larger). This rate of deposition of the droplet and the gauge of the needle used would result in certain operating efficiencies with respect to the number of droplets that can be applied to the paper or other articles per hour.

The sheets or targets are systematically and continually positioned underneath the end of the glue needle 11. The speed of positioning the targets coordinates with the air pressure applied to the bottle of glue 10 (x-axis of FIG. 6), which also must coordinate at the optimum range for a particular gauge needle. For example, if it is desired to process 17,000 sheets of paper per hour, and if the pressure on the glue bottle is $\frac{3}{4}$ psi, an 18 gauge needle would be required so that these three points coincide within (See "OPT" FIG. 6) the optimum recommended area of operation. At a slower rate of deposition of droplets (SR on FIG. 6) a 19 gauge needle would provide approximately 14,000 deposition of droplets per hour at $\frac{1}{2}$ psi bottle pressure. The optimum operating conditions for this device are shown within the bulge on the graph, FIG. 6.

The relationship of the gauge of the needle (diameter A on FIG. 2) to the inside diameter B of the teflon sleeve 6 should also be coordinated with respect to the viscosity of the glue, the rate of deposition of droplets, and air pressure supplied. A general ratio of the outside diameter A of the needle 7 and the inside diameter B of the teflon sleeve 6 is as follows: $ODA/IDB=0.5\pm30\%$. This ratio is valid for viscosities in the range of glue viscosity, between 150 to 300 cp.

Figure 7:
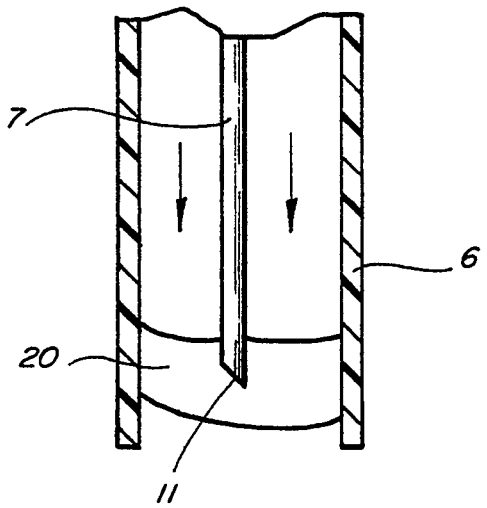
FIG. 7 is a partial cutaway side view of the tip of the glue needle and sleeve, showing the accumulation of a discreet amount of glue just prior to it being deposited on the sheet by a burst of air pressure.

In utilizing this invention, the end of the glue needle 11 is slightly above the lower end of the teflon sleeve 6, as best shown in FIG. 7. In the preferred embodiment, the end of the glue needle 11 is $\frac{1}{2}$ millimeter to 1 millimeter from the lowest edge of the teflon sleeve 6. It has been found that these particular dimensions are most efficient in depositing the droplets onto the targets.

The unique design described above utilizes two concentric nozzles (the teflon sleeve 6 for laminar air flow and the needle 7 for delivery of the adhesive) to allow the metered and timed deposition of glue upon sheets which are moved past the glue head 16 by rapid mechanical means. The speed of the sheets to be glued coordinates with the air pressure on the glue bottle and the pulsed laminar air flow delivered by the air pressure inlet tube 2 so that the number of drops (or dots) per hour delivered establishes an efficient system for depositing discreet droplets of glue onto moving sheets of paper.

The instant device allows for much less downtime than the current nozzle system since the glue droplet itself is actively driven away from the end of the nozzle 7. Prior efforts involving a suction effect or the effect of gravity for separating the glue from the end of the glue head are not as efficient as the instant device. The glue supply assembly 5 (comprising the glue cylinder 8 and 9 and glue needle 7) as well as the main chamber, lower chamber and sleeve can be totally replaceable so that any downtime made necessary by any manufacturing condition is greatly reduced. Since the air pulse separates the droplet of glue from the needle, the pressure applied from the air pulse allows the droplet to be deposited as a unit rather than to be separated and basically "sprayed" onto the article. Resin glues will remoisten the end of the needle, thus also eliminating clogging of the nozzle.

The composition of the main portion of this particular glue junction chamber, air supply tube, and glue supply assembly may be of any suitable material, such a plastic, while the lower sleeve 6 is made of teflon or similar slick, non-porous material. The glue needle 7 is preferably made of stainless steel. Utilizing this material eliminates the corrosion when the ammonia in standard glues contact standard brass nozzles.

Another unique aspect of this device is its ability to be especially useful with respect to self-seal glues. These self-seal glues have microcapsules or balloons emulsified in the glue compound itself. These encapsulated balloons are held in suspension in the glue. When the glue is compressed, as in folding one paper over another, the balloons in suspension burst thus making the glue stick. In the instant application, the blast of pulsed air bursts some of these encapsulated balloons so that the droplets stick where they land in place on the sheet. Further sealing of the sheet, by folding one sheet over another and applying pressure, breaks all of the capsules and sets the glue in place. With the pulse air feature of this particular device, the self-seal glue will stay in place once contact with the target is accomplished.

The pressures, diameters of tubing, gauge of needles and other variables described in the above Specification are meant for means of illustration only and not as a limitation. While the glue head is normally vertical, it can be tipped slightly to accommodate alternate applications. It has been found that this particular system of depositing glue droplets on sheets of paper is quite efficient when done within the parameters stated in the Specification. However, many variations of glue viscosity, gauge needles, or other variables may also be used while still within keeping of this particular disclosure.

Having fully disclosed my invention, we claim:

1. An air pressure glue application head, comprising:

(a) a main mixing chamber fluidly connected to a smaller, essentially cylindrical lower chamber;

(b) an air pressure inlet tube fluidly connecting a source of air pressure to said main chamber;

(c) an essentially cylindrical removable lower sleeve connected around and below said lower chamber; and (d) a glue dispensing assembly sealably connected to the top of said main chamber, further comprising a thin glue dispensing needle, wherein the top of said needle is fluidly connected to a source of glue and wherein the lower portion of said needle is positioned in the center of said main chamber, lower chamber and sleeve;

whereby, as a droplet of glue accumulates on the lower end of said needle, air pressure is supplied through said main chamber, lower chamber and sleeve to blow said droplet out the lower end of said sleeve onto a target to be glued.

2. An air pressure glue application head as in claim 1, wherein said main chamber is essentially vertical and said air pressure inlet is essentially horizontal to said main chamber.

3. An air pressure glue application head as in claim 1, further comprising an air pressure solenoid which coordinates a burst of air pressure through said main chamber to said sleeve as a droplet of glue accumulates on the lower end of said needle.

4. An air pressure glue application head as in claim 1, wherein the size of said glue needle is 18 to 24 gauge.

5. An air pressure glue application head as in claim 1, wherein the air pressure delivered to said main chamber is 8 psi to 14 psi.

6. An air pressure glue application head as in claim 1, wherein the lower end of said needle is approximately $\frac{1}{2}$ mm to 1 mm from the lower end of said sleeve.

7. An air pressure glue application head as in claim 1, wherein said needle is made of stainless steel.

8. An air pressure glue application head as in claim 1, wherein said lower sleeve is made of a slick, non-porous material.

9. An air pressure glue application head as in claim 1, wherein the ratio of the outside diameter of said needle to the inside diameter of said sleeve is 0.5 plus or minus 30 percent.

10. An air pressure glue application head as in claim 1, wherein said application head is completely replaceable.

11. An air pressure glue application head as in claim 1, wherein glue is supplied to said glue dispensing needle at a glue bottle pressure of $\frac{1}{8}$ psi to 1 psi.

12. An air pressure glue application head, comprising:

(a) a main mixing chamber;

(b) a first source of air pressure fluidly connected to said main chamber;

(c) a glue dispensing assembly comprising a source of latex glue under a second source of air pressure and an elongated glue needle located within said main chamber, said latex glue being supplied to the lower end of said needle in discreet droplets solely by means of said second source of air pressure; and (d) a slick, non-porous lower sleeve surrounding said lower end of said elongated glue needle.

* * * * *